US009010445B2

(12) United States Patent
Yajure

(10) Patent No.: US 9,010,445 B2
(45) Date of Patent: Apr. 21, 2015

(54) BALL GRAB TUBULAR HANDLING

(75) Inventor: Edgar Fernando Yajure, Calgary (CA)

(73) Assignee: Tesco Corporation, Houston, TX (US)

( * ) Notice: Subject to any disclaimer, the term of this patent is extended or adjusted under 35 U.S.C. 154(b) by 580 days.

(21) Appl. No.: 13/316,173

(22) Filed: Dec. 9, 2011

(65) Prior Publication Data

US 2013/0146278 A1 Jun. 13, 2013

(51) Int. Cl.
*E21B 19/16* (2006.01)

(52) U.S. Cl.
CPC ..... *E21B 19/16* (2013.01)

(58) Field of Classification Search
USPC ..... 166/380, 382, 77.51; 414/908, 910; 294/86.25
See application file for complete search history.

(56) References Cited

U.S. PATENT DOCUMENTS 2,179,594 A * 11/1939 Johnson ..... 294/86.22
7,552,764 B2 6/2009 Weems et al.

* cited by examiner

*Primary Examiner* — Cathleen Hutchins
(74) *Attorney, Agent, or Firm* — Fletcher Yoder, P.C.

(57) ABSTRACT

A casing running tool is provided having a central mandrel with spiral wedge grooves, an outer cage having generally horizontal slots corresponding to the spiral wedge grooves, and grabber balls disposed between the spiral wedge grooves and the horizontal slots. Each of the spiral wedge grooves has a deeper end and a shallower end, between which the respective grabber balls roll. When a grabber ball is disposed in the shallower end of the respective spiral wedge groove, the grabber ball exerts a radial force against an inner wall of a casing or liner being supported. In addition, the running tool facilitates the application of torque from the running tool to the casing or liner being supported.

19 Claims, 7 Drawing Sheets

BALL GRAB TUBULAR HANDLING

FIELD OF DISCLOSURE

The present disclosure relates generally to the field of well drilling operations. More specifically, embodiments of the present disclosure relate to casing running tools having a central mandrel having spiral wedge grooves, an outer cage having generally horizontal slots corresponding to the spiral wedge grooves, and grabber balls disposed between the spiral wedge grooves and the horizontal slots.

BACKGROUND

In conventional oil and gas operations, a well is typically drilled to a desired depth with a drill string, which includes drill pipe and a drilling bottom hole assembly (BHA). Once the desired depth is reached, the drill string is removed from the hole and casing is run into the vacant hole. In some conventional operations, the casing may be installed as part of the drilling process. A technique that involves running casing at the same time the well is being drilled may be referred to as "casing-while-drilling."

Casing may be defined as pipe or tubular that is placed in a well to prevent the well from caving in, to contain fluids, and to assist with efficient extraction of product. When the casing is properly positioned within a hole or well, the casing is typically cemented in place by pumping cement through the casing and into an annulus formed between the casing and the hole (e.g., a wellbore or parent casing). Once a casing string has been positioned and cemented in place or installed, the process may be repeated via the now installed casing string. For example, the well may be drilled further by passing a drilling BHA through the installed casing string and drilling. Further, additional casing strings may be subsequently passed through the installed casing string (during or after drilling) for installation. Indeed, numerous levels of casing may be employed in a well. For example, once a first string of casing is in place, the well may be drilled further and another string of casing (an inner string of casing) with an outside diameter that is accommodated by the inside diameter of the previously installed casing may be run through the existing casing. Additional strings of casing may be added in this manner such that numerous concentric strings of casing are positioned in the well, and such that each inner string of casing extends deeper that the previously installed casing or parent casing string.

Liner may also be employed in some drilling operations. Liner may be defined as a string of pipe or tubular that is used to case open hole below existing casing. Casing is generally considered to extend all the way back to a wellhead assembly at the surface. In contrast, a liner merely extends a certain distance (e.g., 30 meters) into the previously installed casing or parent casing string. However, a tieback string of casing may be installed that extends from the wellhead downward into engagement with previously installed liner. The liner is typically secured to the parent casing string by a liner hanger that is coupled to the liner and engages with the interior of the upper casing or liner. The liner hanger may include a slip device (e.g., a device with teeth or other gripping features) that engages the interior of the upper casing string to hold the liner in place. It should be noted that, in some operations, a liner may extend from a previously installed liner or parent liner. Again, the distinction between casing and liner is that casing generally extends all the way to the wellhead and liner only extends to a parent casing or liner. Accordingly, the terms "casing" and "liner" may be used interchangeably in the present disclosure. Indeed, liner is essentially made up of similar components (e.g., strings of tubular structures) as casing. Further, as with casing, a liner is typically cemented into the well.

Whether casing or liners are used for any particular well, the casing or liner strings are run into the wellbore using a running tool. It is now recognized that existing techniques for running casing or liner strings into wellbores do not adequately allow for transferring torque to the casing or liner strings. Accordingly, it is now recognized that improved techniques and equipment for running casing or liner strings are desirable.

DETAILED DESCRIPTION

The present invention is designed to respond to such needs. In accordance with one aspect of the invention, a running tool includes an inner body having a plurality of grooves disposed on an outer surface of the inner body. The plurality of grooves are angled diagonally along the outer surface with respect to a central axis of the inner body. The running tool also includes an outer cage disposed radially outside of the outer surface of the inner body. The outer cage includes a plurality of slots extending through a wall of the outer cage, each slot corresponding to a respective groove of the inner body. Each of the plurality of slots are perpendicular with respect to the central axis of the inner body. The running tool also includes a plurality of sliding components, each sliding component disposed between a slot of the outer cage and a respective groove of the inner body.

In accordance with another aspect of the invention, a running tool includes an inner body having a plurality of spiral wedge grooves. The running tool also includes an outer cage having a plurality of horizontal slots. In addition, the running tool includes a plurality of wedging elements, each wedging element disposed between a spiral wedge groove and a horizontal slot.

In accordance with another aspect of the invention, a running tool includes an inner body having first and second pluralities of grooves disposed on an outer surface of the inner body. Each groove of the first plurality of grooves is angled diagonally along the outer surface of the inner body with respect to a central axis of the inner body in a first direction at an angle of approximately 30 degrees. In addition, each groove of the second plurality of grooves is angled diagonally along the outer surface of the inner body with respect to the central axis of the inner body in a second direction opposite the first direction at the angle of approximately 30 degrees. Each groove of the first and second pluralities of grooves gradually deepens from a shallower end to a deeper end of the respective groove. The deeper end of each groove is closer to an upper end of the inner body than the shallower end, and the shallower end of each groove is closer to a lower end of the inner body than the deeper end. The running tool also includes an outer cage disposed radially outside of the outer surface of the inner body. The outer cage includes a plurality of horizontal slots extending through a wall of the outer cage, each horizontal slot corresponding to a respective groove of the inner body. Each horizontal slot has a first circumferential length. In addition, each groove has a second circumferential length that is substantially similar to the first circumferential length of its respective horizontal slot. The running tool also includes a plurality of balls, each ball disposed between a horizontal slot of the outer cage and a respective groove of the inner body. Each ball has an outer diameter sized such that the ball remains disposed between its respective horizontal slot and groove when rolling between the shallower and deeper ends of its respective groove.

DRAWINGS

These and other features, aspects, and advantages of the present invention will become better understood when the following detailed description is read with reference to the accompanying drawings in which like characters represent like parts throughout the drawings, wherein.

Figure 2:
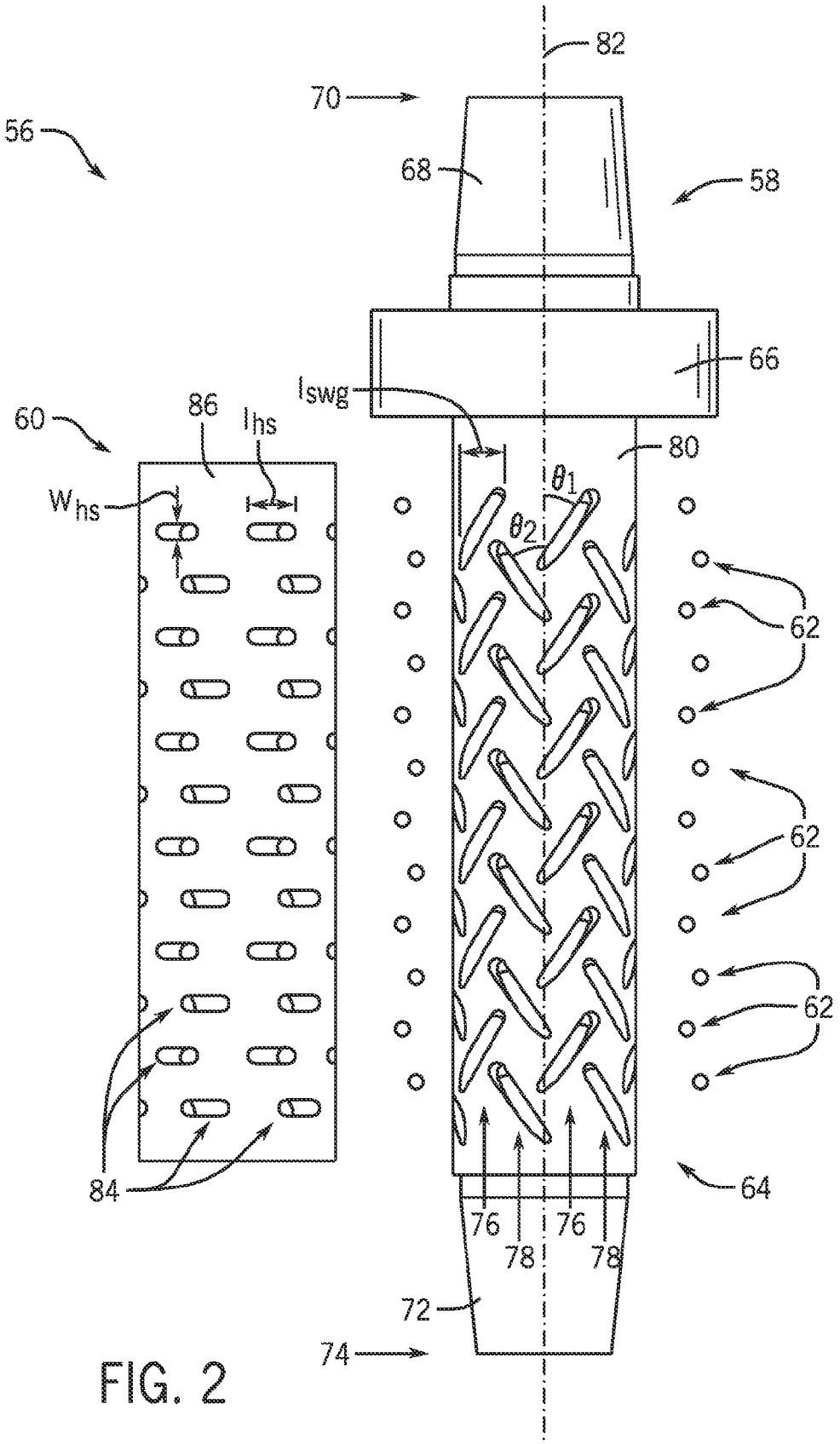
FIG. 2 is an exploded side view of components of a casing running tool in accordance with present techniques.
Figure 7:
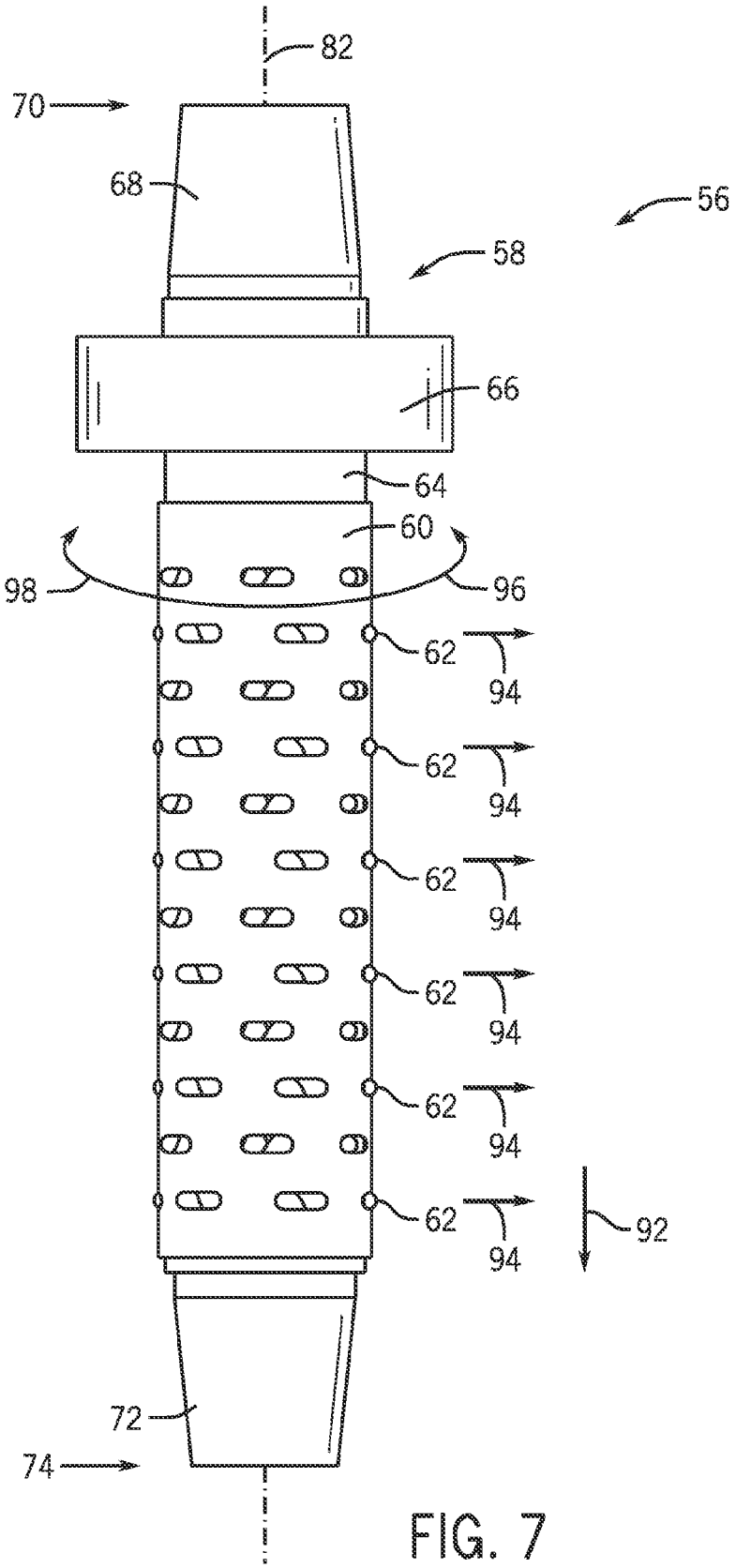
Figure 8:
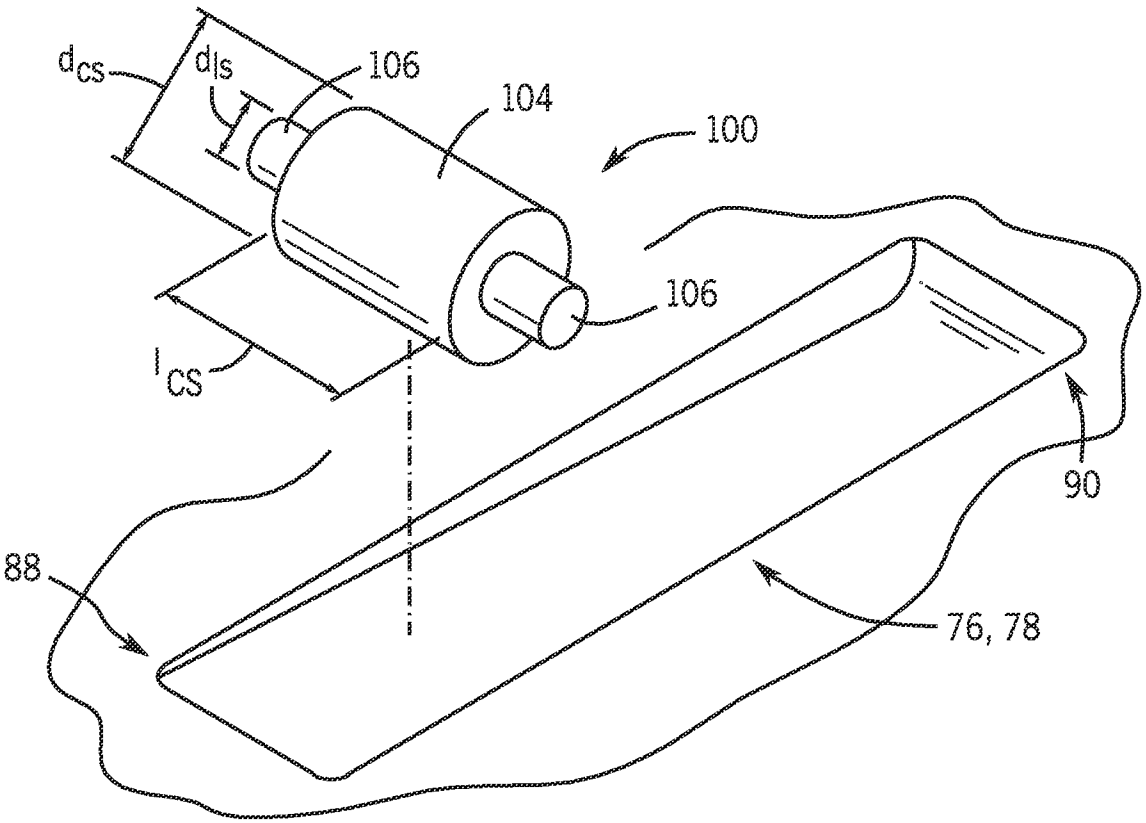

FIG. 7 is a side view of the casing running tool including the central mandrel, outer cage, and wedging elements of FIG. 2 assembled together with the wedging elements located in the shallower ends of their respective spiral wedge grooves in the main body portion of the central mandrel in accordance with present techniques; and FIG. 8 is an exploded perspective view of a spiral wedge groove and a wedging element as a rolling cylinder in accordance with present techniques.

DETAILED DESCRIPTION

The present disclosure relates generally to methods and equipment for running casing or liner strings into a wellbore. More specifically, embodiments of the present disclosure are directed to a casing running tool having a central mandrel with spiral wedge grooves, an outer cage having generally horizontal slots corresponding to the spiral wedge grooves, and grabber balls disposed between the spiral wedge grooves and the horizontal slots. When the running tool is inserted into casing or liner to be run into the wellbore, the grabber balls are forced by interaction with the casing or liner inner wall into deeper ends of their respective spiral wedge grooves, thereby reducing the outer radial displacement of the grabber balls with respect to the outer cage, thus facilitating insertion of the running tool into the casing or liner. Once the running tool has been inserted into the casing or liner and the weight of the casing or liner is supported by the running tool, friction caused by the weight of the casing or liner forces the grabber balls toward shallower ends of their respective spiral wedge grooves, thereby increasing the outer radial displacement of the grabber balls with respect to the outer cage, thus increasing outward radial forces from the grabber balls against an inner bore of the casing or liner, which helps the running tool support the weight of the casing or liner.

It should be noted that, in certain embodiments, the grabber balls may instead be replaced by any suitable sliding components or wedging elements configured to roll and/or slide within their spiral wedges grooves, thereby reducing or increasing the outer radial displacement of the sliding components or wedging elements with respect to the outer cage, thus facilitating insertion of the running tool into the casing or liner, or increasing the outward radial force from the sliding components or wedging elements against the inner bore of the casing or liner. For example, in certain embodiments, the grabber balls may instead be replaced by cylindrical rollers that are configured to roll within their respective spiral wedge grooves, while still being radially retained by their respective horizontal slots. As another example, the grabber balls may instead be replaced by sliding wedges that are configured to slide within their respective spiral wedge grooves, while still being radially retained by their respective horizontal slots. As such, although primarily illustrated in FIGS. 2 through 7 as grabber "balls," the grabber balls will generally be referred to herein as "wedging elements," which may refer to the illustrated grabber balls or any other suitable components that may roll and/or slide within their respective spiral wedge grooves, thereby reducing or increasing the outer radial displacement of the wedging elements with respect to the outer cage.

Furthermore, the running tool facilitates the application of torque from the running tool to the casing or liner being supported. More specifically, a first set of spiral wedge grooves angled diagonally in a first direction facilitates the transfer of torque in a clockwise direction, and a second set of spiral wedge grooves angled diagonally in a second direction opposite the first direction facilitates the transfer of torque in a counterclockwise direction.

Figure 1:
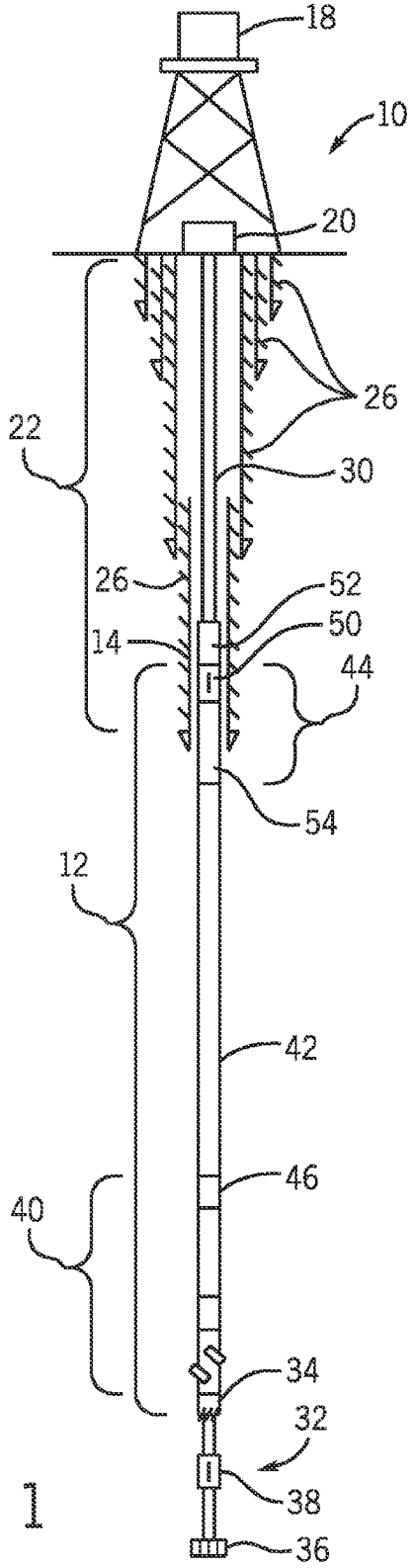
FIG. 1 is a schematic representation of a well being drilled in accordance with present techniques.

Turning to the figures, FIG. 1 is a schematic representation of a well 10 that is being drilled using a casing-while-drilling technique, wherein a liner string 12 is about to be hung within a previously installed liner 14 that was cemented into the well 10 in accordance with present techniques. In other embodiments, different drilling techniques may be employed. The well 10 includes a derrick 18, wellhead equipment 20, and several levels of casing 22 (e.g., conductor pipe, surface pipe, intermediate string, and so forth), which includes the previously installed liner 14, which may be casing in some embodiments. The casing 22 and the liner 14 have been cemented into the well 10 with cement 26. Further, as illustrated in FIG. 1, the liner string 12 is in the process of being hung from the previously installed liner 14, which may be referred to as the parent liner 14.

While other embodiments may utilize different drilling techniques, as indicated above, the well 10 is being drilled using a casing-while-drilling technique. Specifically, the liner string 12 is being run as part of the drilling process. In the illustrated embodiment, a drill pipe 30 is coupled with the liner string 12 and a drilling BHA 32. The drilling BHA 32 is also coupled with an upper portion of the liner string 12 and extends through the liner string 12 such that certain features of the drilling BHA 32 extend out of the bottom of the liner string 12. Indeed, an upper portion of the drilling BHA 32 is disposed within the inside diameter of the liner string 12, while a lower portion of the drilling BHA 32 extends out of a liner shoe 34 at the bottom of the liner string 12. Specifically, in the illustrated embodiment, a drill bit 36 and an under reamer 38 of the drilling BHA 32 extend out from the liner string 12. Thus, the drilling BHA 32 is positioned to initiate and guide the drilling process.

The liner string 12 includes a shoe track 40, a string of tubing 42, and a liner top assembly 44. The shoe track 40 defines the bottom of the liner string 12 and includes the liner shoe 34 to facilitate guiding the liner string 12 through the wellbore. In the illustrated embodiment, the shoe track 40 also includes an indicator landing sub 46 to facilitate proper engagement with the drilling BHA 32, and various other features, such as a pump down displacement plug (PDDP). The string of tubing 42 is essentially the main body of the liner string 12 that connects the shoe track 40 with the liner top assembly 44. The liner top assembly 44, which defines the top of the liner string 12, includes a liner hanger 50 that is capable of being activated and/or deactivated by a liner hanger control tool 52. The liner top assembly 44 may also include a liner drill lock section 54, which includes a liner drill lock that facilitates engagement/disengagement of the drill string 30 from the liner string 12. The liner drill lock may be actuated by external or internal components affixed to or part of a body of the liner hanger 50.

Once a desired depth is reached, the liner string 12 may be hung or set down to facilitate detachment of the drilling BHA 32. As illustrated in FIG. 1, the liner string 12 may be hung from the parent liner 14, and the drilling BHA 32 may be detached from the liner string 12 and pulled out of the well 10 with the drill string 30 and an inner string (not shown). In order to hang the liner string 12 from the parent liner 14, the hanger 50 may be activated with the liner hanger control tool 52. In some embodiments, the hanger 50 is not utilized and the liner string 12 is set on bottom.

The casing and liner strings (e.g., the casing 22, the parent liner 14, and the liner string 12) are run into the well 10 using a running tool. Also described above, the terms "casing" and "liner" may be used interchangeably in the present disclosure. More specifically, while the embodiments described herein may generally refer to the running tools as "casing running tools," it will be understood that the casing running tools described herein may also be used as liner running tools.

FIG. 2 is an exploded side view of components of a casing running tool 56 in accordance with present techniques. As will be appreciated, the casing running tool 56 may be used to run the casing and liner strings of FIG. 1 (e.g., the casing 22, the parent liner 14, and the liner string 12) into the well 10. As illustrated in FIG. 2, the casing running tool 56 includes a central mandrel 58, an outer cage 60, and a plurality of wedging elements 62 (e.g., grabber balls, rolling cylinders, sliding wedges, and so forth) that are disposed between the central mandrel 58 and the outer cage 60 when these components of the casing running tool 56 are assembled. As illustrated in FIG. 2, in certain embodiments, the central mandrel 58 includes a generally cylindrical main body portion 64 that, as described in greater detail below, is configured to be inserted into casing or liners (e.g., the casing 22, the parent liner 14, and the liner string 12 of FIG. 1) to support the weight of the casing or liners while they are inserted into a well, such as the well 10 of FIG. 1. The central mandrel 58 may also include a flange 66, an upper insertion portion 68 near an upper (e.g., top) end 70 of the central mandrel 58, and a lower insertion portion 72 near a lower (e.g., bottom) end 74 of the central mandrel 58.

As illustrated in FIG. 2, the main body portion 64 of the central mandrel 58 includes a plurality of spiral wedge grooves 76, 78 that are disposed on an outer surface 80 of the main body portion 64. In other words, as illustrated, the spiral wedge grooves 76, 78 form generally spiral-shaped patterns along the outer surface 80 of the main body portion 64. In addition, as described in greater detail below, the spiral wedge grooves 76, 78 include a wedge shape, having shallower and deeper ends. Each of the plurality of spiral wedge grooves 76, 78 are angled diagonally with respect to a central axis 82 of the main body portion 64. More specifically, as illustrated, the main body portion 64 includes a first plurality of spiral wedge grooves 76 that are disposed on the outer surface 80 of the main body portion 64 and are angled diagonally with respect to the central axis 82 of the main body portion 64 in a first direction, and a second plurality of spiral wedge grooves 78 that are disposed on the outer surface 80 and are angled diagonally with respect to the central axis 82 of the main body portion 64 in a second direction that is opposite the first direction. In other words, in certain embodiments, each of the first plurality of grooves 76 is generally associated with one of the second plurality of grooves 78, wherein the pair of spiral wedged grooves 76, 78 are spiraled counter to each other. For example, each of the first plurality of grooves 76 is angled diagonally with respect to the central axis 82 along the outer surface 80 of the main body portion 64 at an angle $\theta_1$, whereas each of the second plurality of grooves 78 is angled diagonally with respect to the central axis 82 along the outer surface 80 of the main body portion 64 at an angle $\theta_2$, which may be substantially similar in magnitude to the angle $\theta_1$, but that is in an angular direction opposite $\theta_1$, with respect to the central axis 82 along the surface 80 of the main body portion 64. In certain embodiments, the angles $\theta_1$ and $\theta_2$ may be in a range of approximately 20-40 degrees, and may be, more specifically, approximately 30 degrees.

In addition, as illustrated in FIG. 2, the outer cage 60 includes a plurality of horizontal slots 84 extending through a thin wall 86 of the outer cage 60 and generally perpendicular with respect to the central axis 82 when the casing running tool 56 is assembled. In general, each of the horizontal slots 84 corresponds to a respective spiral wedge groove 76, 78 of the main body portion 64 of the central mandrel 58. However, it will be understood that, in certain embodiments, additional horizontal slots 84 or spiral wedge grooves 76, 78 may be present that do not correspond to spiral wedge grooves 76, 78 or horizontal slots 84, respectively. In certain embodiments, the thin wall 86 of the outer cage 60 may have a thickness in a range of approximately 0.015-0.15 inches, and, more particularly, approximately 0.125 inches. In addition, it will be understood that the thin wall 86 of the outer cage 60 has an outer diameter that is sized just smaller than an inner wall diameter of the casing or liners that are to be supported by the casing running tool 56.

When the casing running tool 56 is assembled, the outer cage 60 is disposed radially outside of the outer surface 80 of the main body portion 64 of the central mandrel 58, with each of the wedging elements 62 disposed between a horizontal slot 84 of the outer cage 60 and a respective spiral wedge groove 76, 78 of the main body portion 64 of the central mandrel 58. In addition, each of the horizontal slots 84 may have a circumferential length $l_{hs}$ (e.g., a horizontal component) about a circumference of the thin wall 86 of the outer cage 60 that is substantially similar to a circumferential length $l_{swg}$ of a horizontal component of the respective spiral wedge groove 76, 78 about a circumference of the outer surface 80 of the main body portion 64 of the central mandrel 58 such that movement (e.g., rolling and/or sliding) of the wedging elements 62 is constrained at opposite ends of both the horizontal slot 84 of the outer cage 60 and a respective spiral wedge groove 76, 78 of the main body portion 64 of the central mandrel 58, which is described in greater detail below.

Figure 3:
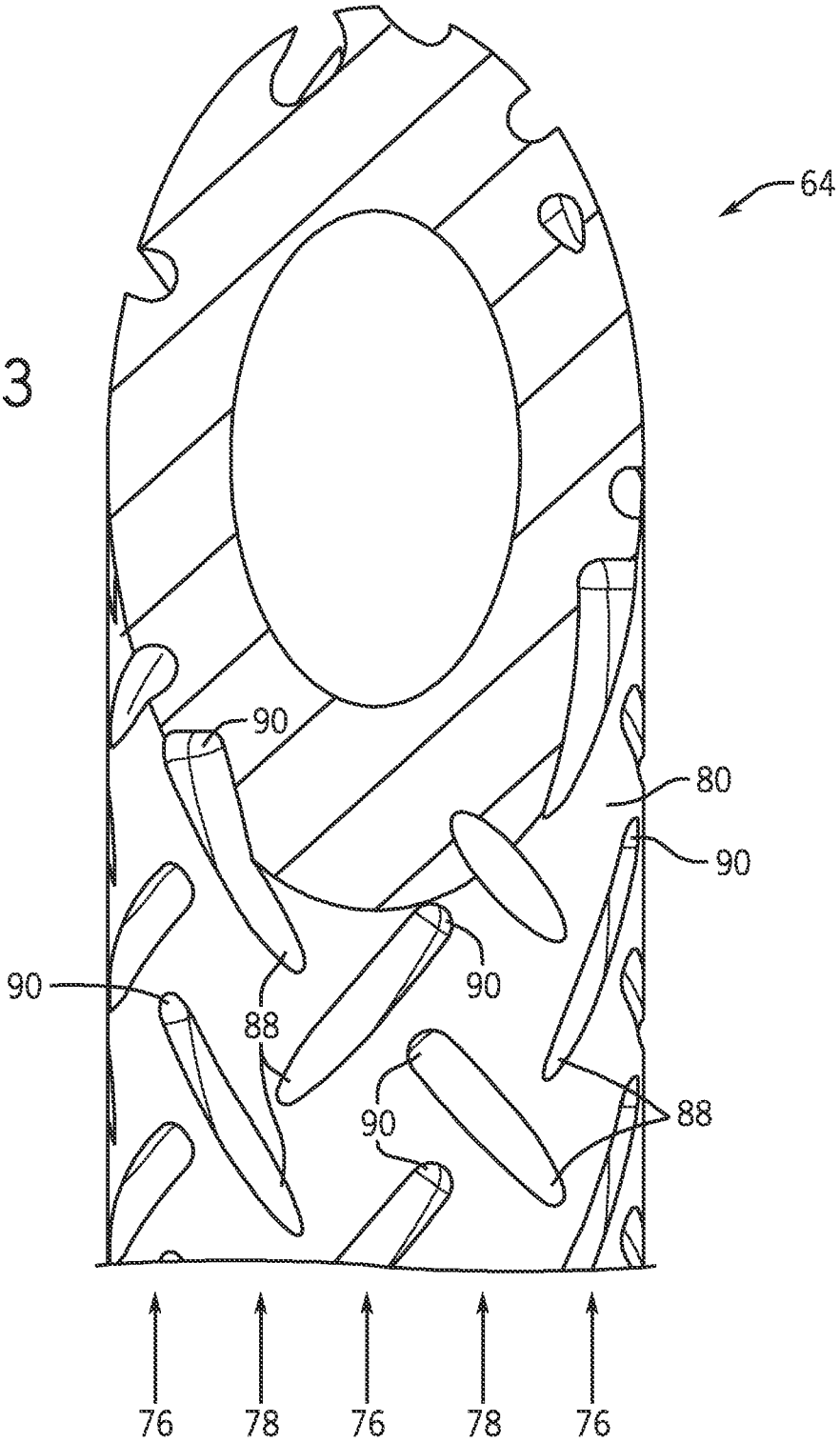
FIG. 3 is a cutaway perspective view of a main body portion of a central mandrel of the casing running tool of FIG. 2 in accordance with present techniques.

FIG. 3 is a cutaway perspective view of the main body portion 64 of the central mandrel 58 of the casing running tool 56 of FIG. 2 in accordance with present techniques. As illustrated, each of the plurality of spiral wedge grooves 76, 78 on the outer surface 80 of the main body portion 64 includes a first end 88 and a second end 90. In general, the first end 88 of each spiral wedge groove 76, 78 is relatively shallow compared to the second end 90 of the spiral wedge groove 76, 78. As such, each spiral wedge groove 76, 78 gradually deepens from the first shallower end 88 to the second deeper end 90 of the spiral wedge groove 76, 78. In general, the first shallower ends 88 of the spiral wedge grooves 76, 78 are closer to the lower (e.g., bottom) end 74 of the main body portion 64 of the central mandrel 58, whereas the second shallower ends 90 of the spiral wedge grooves 76, 78 are closer to the upper (e.g., top) end 70 of the main body portion 64 of the central mandrel 58.

Figure 4:
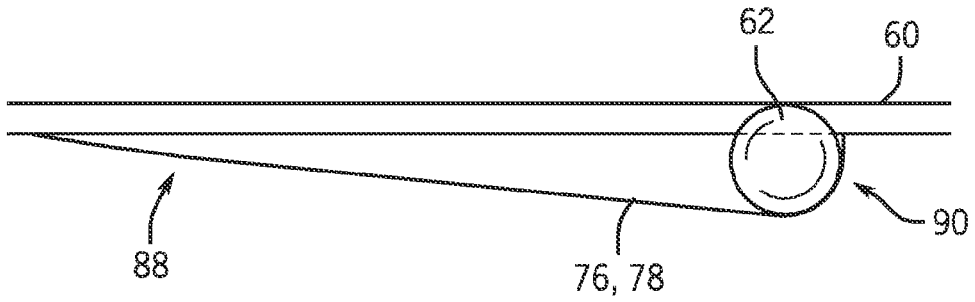
FIG. 4 is a cutaway side view of a spiral wedge groove in the main body portion of the central mandrel of the casing running tool, with a wedging element located in a deeper end of the spiral wedge groove in accordance with present techniques.
Figure 5:
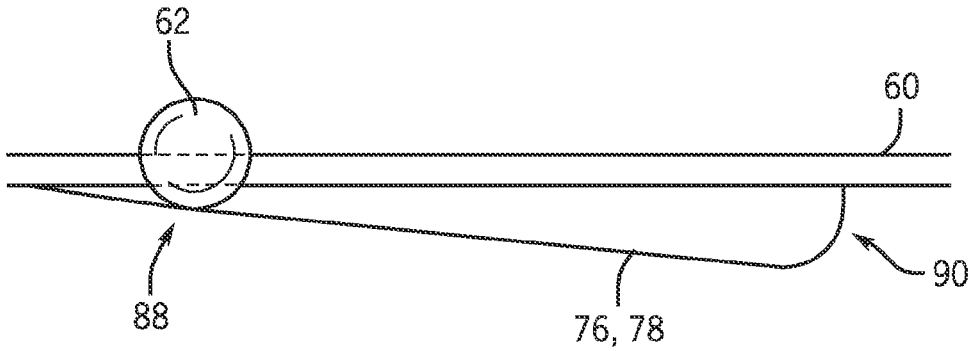
FIG. 5 is a cutaway side view of a spiral wedge groove in the main body portion of the central mandrel of the casing running tool, with the wedging element located in a shallower end of the spiral wedge groove in accordance with present techniques.

As described in greater detail below, the gradual deepening of the spiral wedge grooves 76, 78 affects the radial displacement of the respective wedging element 62 disposed between the spiral wedge groove 76, 78 and the respective horizontal slot 84 in the outer cage 60. FIGS. 4 and 5 illustrate how the radial displacement of a wedging element 62 changes as the wedging element 62 rolls and/or slides between the first shallower end 88 of the spiral wedge groove 76, 78 and the second deeper end 90 of the spiral wedge groove 76, 78 in accordance with present techniques. As illustrated in FIG. 5, when the wedging element 62 is located at the shallower first end 88 of the spiral wedge groove 76, 78, a substantial portion of the wedging element 62 extends radially outward through the outer cage 60. Conversely, as illustrated in FIG. 4, when the wedging element 62 is located at the deeper second end 90 of the spiral wedge groove 76, 78, a substantial portion of the wedging element 62 is disposed radially within the outer cage 60. As described in greater detail below, when the wedging element 62 is located at the shallower first end 88 of the spiral wedge groove 76, 78, the wedging element 62 may exert a radial force against an inner wall of casing or a liner, such that the weight of the casing or liner may be supported during running the casing or liner into a well.

When the wedging elements 62 are grabber balls, each of the wedging elements 62 has an outer diameter that is less than a width $w_{hs}$ of the horizontal slots 84 of the outer cage 60. As such, the grabber balls are radially retained within their respective horizontal slots 84, but are also allowed to roll between the first shallower end 88 of the spiral wedge groove 76, 78 and the deeper second end 90 of their respective spiral wedge groove 76, 78. However, as described in greater detail below with respect to FIG. 8, when the wedging elements 62 are rolling cylinders or sliding wedges, the wedging elements 62 may be radially retained within their respective horizontal slots 84 by other means. For example, the rolling cylinders or sliding wedges may have central sections that are allowed to extend radially outward beyond the outer cage 60, and lateral sections (e.g., having smaller outer diameters than the central sections) that are radially retained between the outer cage 60 and the respective spiral wedge groove 76, 78.

Figure 6:
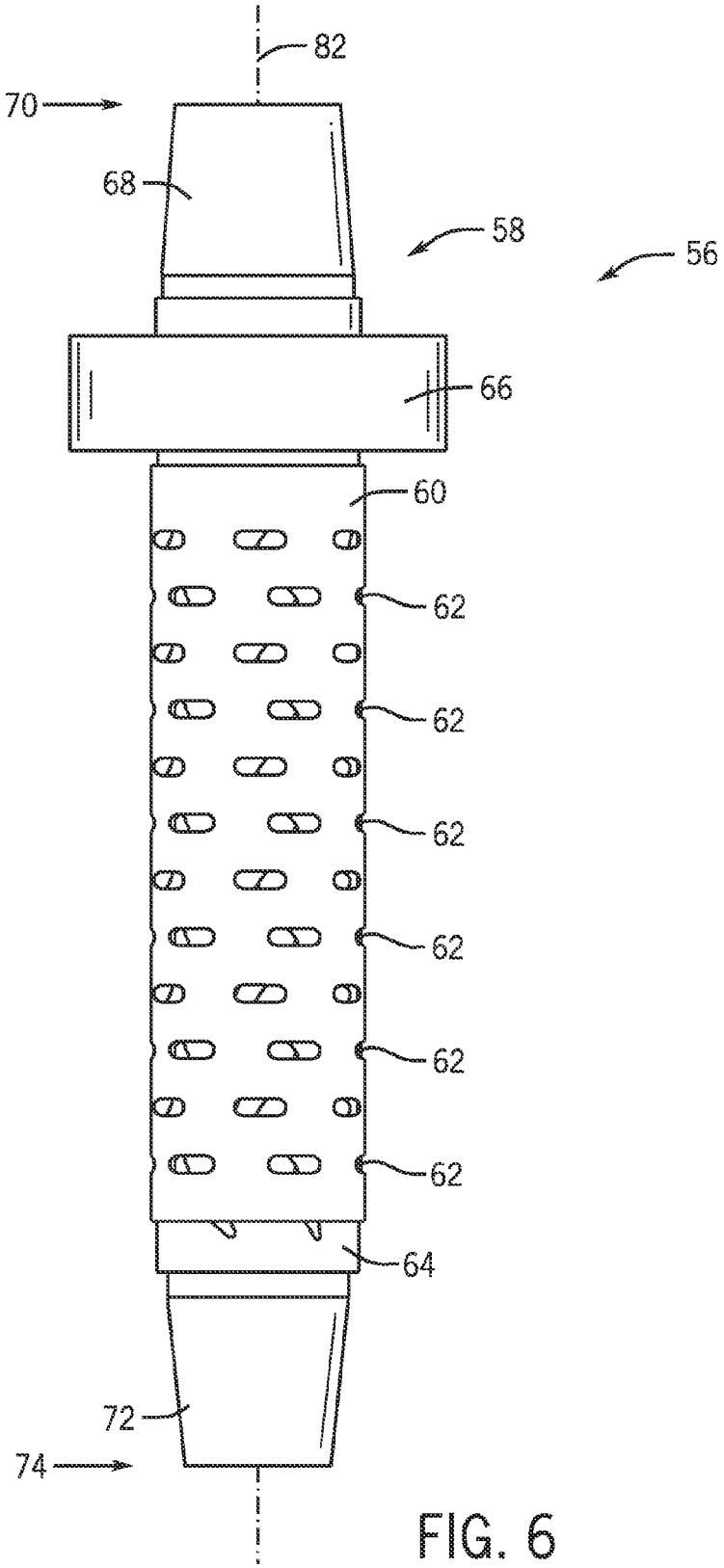
FIG. 6 is a side view of the casing running tool including the central mandrel, outer cage, and wedging elements of FIG. 2 assembled together with the wedging elements located in the deeper ends of their respective spiral wedge grooves in the main body portion of the central mandrel in accordance with present techniques.

FIGS. 6 and 7 are side views of the casing running tool 56 including the central mandrel 58, outer cage 60, and wedging elements 62 of FIG. 2 assembled together in accordance with present techniques. More specifically, FIG. 6 illustrates the casing running tool 56 when the wedging elements 62 are located in the deeper end 90 of their respective spiral wedge grooves 76, 78, and FIG. 7 illustrates the casing running tool 56 when the wedging elements 62 are located in the shallower end 88 of their respective spiral wedge grooves 76, 78. In the configuration illustrated in FIG. 6, the outer cage 60 is at its highest (e.g., closest to the upper end 70) axial alignment relative to the main body portion 64 of the central mandrel 58. More specifically, the interaction between the horizontal slots 84 of the outer cage 60 and the wedging elements 62 disposed therein restricts further upward axial displacement of the outer cage 60 toward the upper end 70 of the main body portion 64 of the central mandrel 58. When the wedging elements 62 are disposed in the deeper ends 90 of their respective spiral wedge grooves 76, 78, as illustrated in FIG. 6, the casing running tool 56 may be inserted into an inner bore of the casing or liner (e.g., the casing 22, the parent liner 14, and the liner string 12 of FIG. 1) that is to be supported by the casing running tool 56. This is due at least in part to the fact that only a small portion of the wedging elements 62 extend radially outside of the outer cage 60 (e.g., as illustrated in FIG. 4). Furthermore, while inserting the casing running tool 56 into the inner bore of the casing or liner, frictional forces will tend to drive the wedging elements 62 toward the deeper ends 90 of their respective spiral wedge grooves 76, 78, further facilitating insertion of the casing running tool 56 into the inner bore of the casing or liner.

Once the casing running tool 56 has been inserted into the inner bore of the casing or liner, the casing running tool 56 may begin supporting the weight of the casing or liner. As such, the inner bore of the casing or liner will begin exerting a downward axial force on the casing running tool 56 due to gravity, as illustrated by arrow 92 in FIG. 7. More specifically, frictional forces between the inner bore of the casing or liner and the wedging elements 62 of the casing running tool 56 urge the wedging elements 62 downward toward the shallower ends 88 of their respective spiral wedge grooves 76, 78. FIG. 7 illustrates the outer cage 60 in a configuration where the outer cage 60 is at its lowest (e.g., closest to the lower end 74) axial alignment relative to the main body portion 64 of the central mandrel 58. More specifically, the interaction between the horizontal slots 84 of the outer cage 60 and the wedging elements 62 disposed therein restrict further downward axial displacement of the outer cage 60 toward the lower end 74 of the main body portion 64 of the central mandrel 58. When the wedging elements 62 are disposed in the shallower ends 88 of their respective spiral wedge grooves 76, 78, as illustrated in FIG. 7, the wedging elements 62 exert a maximum radial force against the inner bore of the casing or liner being supported, as illustrated by arrows 94. This is due at least in part to the wedging elements 62 extending radially outside of the outer cage 60 by a maximum radial displacement (e.g., as illustrated in FIG. 5).

Therefore, as the casing running tool 56 supports a greater amount of the weight of the casing or liner being supported, the radial force exerted by the wedging elements 62 against the inner bore of the casing or liner is also increased. As such, the casing running tool 56 provides weight-supporting capacity that is proportional to the amount of weight being supported. In other words, as the weight of the casing or liner being supported increases, the weight-supporting capacity of the casing running tool 56 similarly increases. Conversely, when no weight is being supported by the casing running tool 56, the casing running tool 56 may be easily inserted and/or slowly extracted from an inner bore of casing or liners.

Furthermore, the casing running tool 56 enables torque to be transferred from the casing running tool 56 to the casing or liner being supported in both circumferential directions. More specifically, as described above, the main body portion 64 of the casing running tool 56 includes a first plurality of spiral wedge grooves 76 and a second plurality of spiral wedge grooves 78 that are angled diagonally with respect to the central axis of the main body portion 64 in opposite directions. As such, when torque is applied from the casing running tool 56 to the casing or liner in a first circumferential direction (e.g., counterclockwise) about the central axis 82, illustrated by arrow 96, the wedging elements 62 disposed in the first plurality of spiral wedge grooves 76 will support the weight of the casing or liner, as well as facilitate transfer of the torque to the casing or liner.

Conversely, when torque is applied from the casing running tool 56 to the casing or liner in a second circumferential direction (e.g., clockwise) about the central axis 82 opposite the first circumferential direction, as illustrated by arrow 98, the wedging elements 62 disposed in the second plurality of spiral wedge grooves 78 will support the weight of the casing or liner, as well as facilitate transfer of the torque to the casing or liner. It will be understood that, in certain embodiments, the main body portion 64 of the casing running tool 56 may include only the spiral wedge grooves 76 (which are angled diagonally in a first direction relative to the central axis 82), or only the spiral wedge grooves 78 (which are angled diagonally in a second direction opposite the first direction relative to the central axis 82). In such embodiments, torque may be transferred from the casing running tool 56 to the casing or liner being supported in one circumferential direction, as opposed to the bi-directional torque transferring capability described above.

As described above, in certain embodiments, the wedging elements 62 may not be grabber "balls," as illustrated in FIGS. 2 through 7. Rather, the wedging elements 62 may instead be rolling cylinders, sliding wedges, or any other suitable wedging element 62 configured to roll and/or slide within its respective spiral wedge groove 76, 78. For example, FIG. 8 is an exploded perspective view of a spiral wedge groove 76, 78 and a wedging element 62 as a rolling cylinder 100 in accordance with present techniques. As illustrated, the rolling cylinder 100 is configured to roll within its respective spiral wedge groove 76, 78 but still be radially retained by its respective horizontal slot 84 of the outer cage 60. More specifically, the rolling cylinder 100 illustrated in FIG. 8 includes a central section 104 having an outer diameter $d_{cs}$, and two lateral sections 106 having an outer diameter $d_{ls}$ that is smaller than the outer diameter $d_{cs}$ of the central section 104. In addition, the central section 104 of the rolling cylinder 100 has a width $w_{cs}$ that is slightly smaller than the width $w_{hs}$ of the respective horizontal slot 84 such that the central section 104 is allowed to extend radially outward through the horizontal slot 84. Conversely, the lateral sections 106 of the rolling cylinder 100 will be radially blocked by the outer cage 60, thereby radially retaining the rolling cylinder 100 between the outer cage 60 and the spiral wedge groove 76, 78. It will be understood that a wedging element 62 that is a sliding wedge configured to slide within its respective spiral wedge groove 76, 78 may have similar features for radially retaining the sliding wedge between the outer cage 60 and the respective spiral wedge groove 76, 78, while also enabling a portion (e.g., similar to the central section 104 of the rolling cylinder 100) to extend radially outward from the respective horizontal slot 84.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A running tool, comprising:

an inner body comprising a plurality of grooves disposed on an outer surface of the inner body, wherein the plurality of grooves are angled diagonally along the outer surface with respect to a central axis of the inner body;

an outer cage disposed radially outside of the outer surface of the inner body, wherein the outer cage comprises a plurality of slots extending through a wall of the outer cage, each slot corresponding to a respective groove of the inner body, wherein a respective length of each of the plurality of slots is perpendicular with respect to the central axis of the inner body; and a plurality of sliding components, each sliding component disposed between a slot of the outer cage and a respective groove of the inner body.

2. The running tool of claim 1, wherein the plurality of grooves comprises a first plurality of grooves angled diagonally about a circumference of the inner body and along the outer surface with respect to the central axis of the inner body in a first direction, and a second plurality of grooves angled diagonally about the circumference and along the outer surface with respect to the central axis of the inner body in a second direction opposite the first direction.

3. The running tool of claim 2, wherein each groove of the first plurality of grooves is angled diagonally about the circumference and along the outer surface with respect to the central axis of the inner body in the first direction at a first angle having a first magnitude, and each of the second plurality of grooves is angled diagonally about the circumference and along the outer surface with respect to the central axis of the inner body in the second direction at a second angle having the first magnitude.

4. The running tool of claim 3, wherein the first magnitude is in a range of approximately 20-40 degrees.

5. The running tool of claim 1, wherein each groove of the plurality of grooves gradually deepens from a shallower end to a deeper end of the groove.

6. The running tool of claim 5, wherein the deeper end of each groove is closer to an upper end of the inner body than the shallower end, and the shallower end of each groove is closer to a lower end of the inner body than the deeper end.

7. The running tool of claim 1, wherein the wall of the outer cage has a thickness in a range of approximately 0.015-0.15 inches.

8. The running tool of claim 1, wherein each sliding component comprises a ball having an outer diameter that is less than a width of each slot of the outer cage, and that enables the ball to roll from a first end of the respective groove to a second end of the respective groove.

9. The running tool of claim 1, wherein each slot extends from a respective first slot end to a respective second slot end by a first distance in a circumferential direction along the outer cage, wherein each groove extends from a first groove end to a second groove end by a second distance in a circumferential direction along the outer surface of the inner body, wherein the first and second distances are substantially similar.

10. A running tool, comprising:

an inner body comprising a plurality of spiral wedge grooves, wherein each spiral wedge groove is angled diagonally about a circumference of the inner body and along an outer surface of the inner body with respect to a central axis of the inner body;

an outer cage comprising a plurality of horizontal slots; and a plurality of wedging elements, each wedging element disposed between a respective spiral wedge groove and a corresponding horizontal slot.

11. The running tool of claim 10, wherein the plurality of spiral wedge grooves comprises a first plurality of spiral wedge grooves, and a second plurality of spiral wedge grooves that spiral counter to the first plurality of spiral wedge grooves.

12. The running tool of claim 10, wherein each spiral wedge groove is angled diagonally about the circumference of the inner body and along the outer surface of the inner body with respect to the central axis of the inner body by an angle having a magnitude in a range of approximately 20-40 degrees.

13. The running tool of claim 12, wherein each spiral wedge groove is angled diagonally about the circumference of the inner body and along the outer surface of the inner body with respect to the central axis of the inner body by an angle having a magnitude of approximately 30 degrees.

14. The running tool of claim 10, wherein each spiral wedge groove extends from a relatively shallow first end to a relatively deep second end.

15. The running tool of claim 14, wherein the first end of each spiral wedge groove is closer to a bottom end of the inner body than the second end of the spiral wedge groove.

16. The running tool of claim 10, wherein the outer cage has a wall thickness of approximately 0.125 inches.

17. The running tool of claim 10, wherein each wedging element comprises a grabber ball having an outer diameter sized such that the grabber ball remains disposed between the respective spiral wedge groove and corresponding horizontal slot when rolling between first and second ends of the respective spiral wedge groove.

18. The running tool of claim 10, wherein each horizontal slot has a first circumferential length, and each spiral wedge groove has a second circumferential length that is substantially similar to the first circumferential length of the corresponding horizontal slot.

19. A running tool, comprising:

an inner body comprising first and second pluralities of grooves disposed on an outer surface of the inner body, wherein each groove of the first plurality of grooves is angled diagonally about a circumference of the inner body and along the outer surface of the inner body with respect to a central axis of the inner body in a first direction at a first angle having a first magnitude of approximately 30 degrees, and each groove of the second plurality of grooves is angled diagonally about the circumference of the inner body and along the outer surface of the inner body with respect to the central axis of the inner body in a second direction opposite the first direction at a second angle having a second magnitude of approximately 30 degrees, wherein each groove of the first and second pluralities of grooves gradually deepens from a shallower end to a deeper end of the respective groove, wherein the deeper end of each groove is closer to an upper end of the inner body than the shallower end, and the shallower end of each groove is closer to a lower end of the inner body than the deeper end;

an outer cage disposed radially outside of the outer surface of the inner body, wherein the outer cage comprises a plurality of horizontal slots extending through a wall of the outer cage, each horizontal slot corresponding to a respective groove of the inner body, wherein each horizontal slot has a first circumferential length, and each groove has a second circumferential length that is substantially similar to the first circumferential length of the respective horizontal slot corresponding to the respective groove; and a plurality of balls, each ball disposed between a horizontal slot of the outer cage and a respective groove of the inner body, wherein each ball has an outer diameter sized such that the ball remains disposed between the respective horizontal slot and groove when rolling between the shallower and deeper ends of the respective groove.

* * * * *